US006098852A

United States Patent [19]

Weiler et al.

[11] Patent Number: 6,098,852

[45] Date of Patent: Aug. 8, 2000

[54] TIP FOR LIQUID DROP DISPENSING CONTAINER

[75] Inventors: Gerhard H. Weiler, Woodstock; Ralph Kaufmann, Wonder Lake, both of Ill.

[73] Assignee: Automatic Liquid Packaging, Inc., Woodstock, Ill.

[21] Appl. No.: 09/238,519

[22] Filed: Jan. 27, 1999

[51] Int. Cl.[7] ..... B65D 47/18

[52] U.S. Cl. ..... 222/420; 222/547; 222/566; 222/575

[58] Field of Search ..... 222/420–422, 222/566, 547, 575

[56] References Cited

U.S. PATENT DOCUMENTS

| | | | |
|---|---|---|---|
| D. 273,767 | 5/1984 | Weiler | D9/352 |
| D. 369,211 | 4/1996 | Weiler | D24/110 |
| 2,920,624 | 1/1960 | Lerner et al. | 222/422 |
| 4,055,282 | 10/1977 | Komendowski | 222/421 |
| 4,176,153 | 11/1979 | Weiler et al. | 264/524 |
| 4,325,913 | 4/1982 | Wardlaw | 222/420 |
| 4,509,566 | 4/1985 | Phillips | 222/422 |
| 4,707,966 | 11/1987 | Weiler et al. | 53/410 |
| 4,901,873 | 2/1990 | Weiler | 215/32 |
| 5,246,145 | 9/1993 | Leoncavallo et al. | 222/420 |
| 5,351,462 | 10/1994 | Anderson et al. | 53/410 |
| 5,462,200 | 10/1995 | Weiler | 222/83 |
| 5,711,453 | 1/1998 | Weiler | 222/83 |

*Primary Examiner*—J. Casimer Jacyna
*Attorney, Agent, or Firm*—Olson & Hierl, Ltd.

[57] ABSTRACT

A liquid container includes a drop dispensing tip with a hollow stem which defines a liquid passageway and an interior partition wall in the passageway. The partition wall separates the liquid passageway into an upstream chamber and a downstream chamber. Flow communication between these two chambers is provided by a liquid passage in the partition wall. The liquid passage guides liquid against an impingement surface in the downstream chamber from which the liquid is dispensed dropwise.

7 Claims, 3 Drawing Sheets

FIG.3
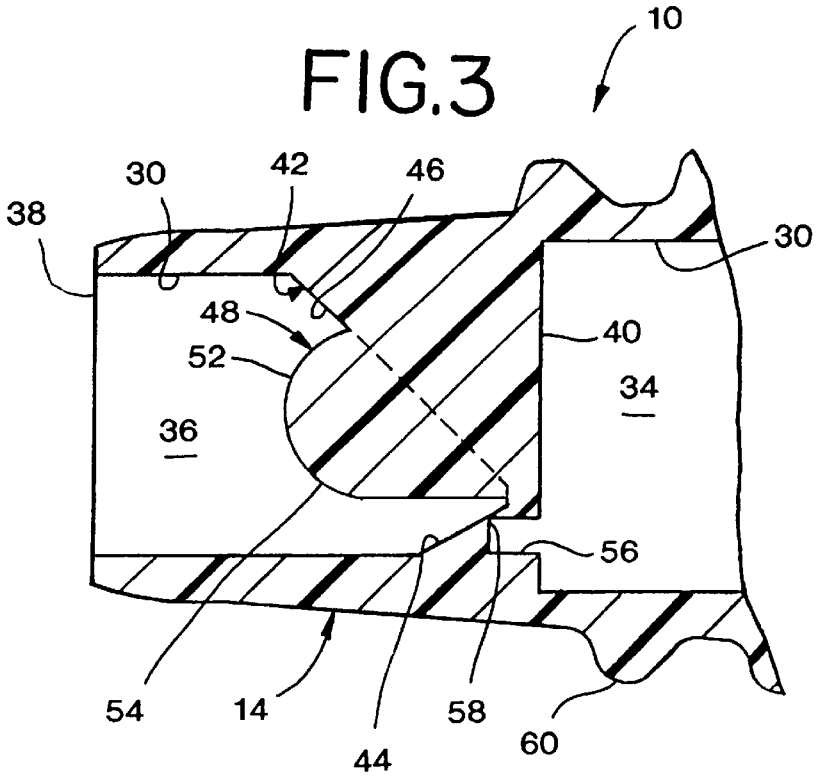
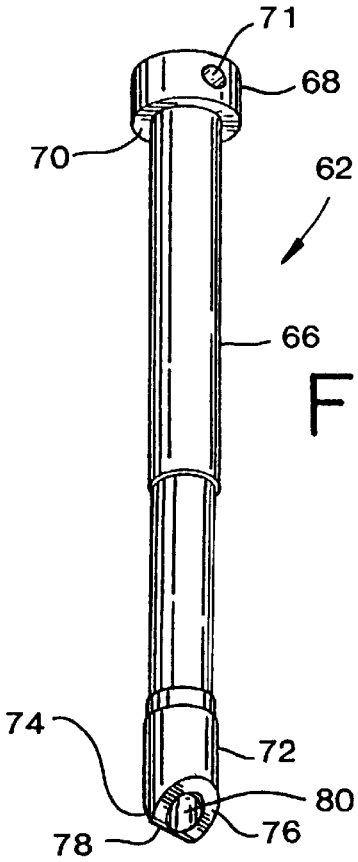
FIG.4
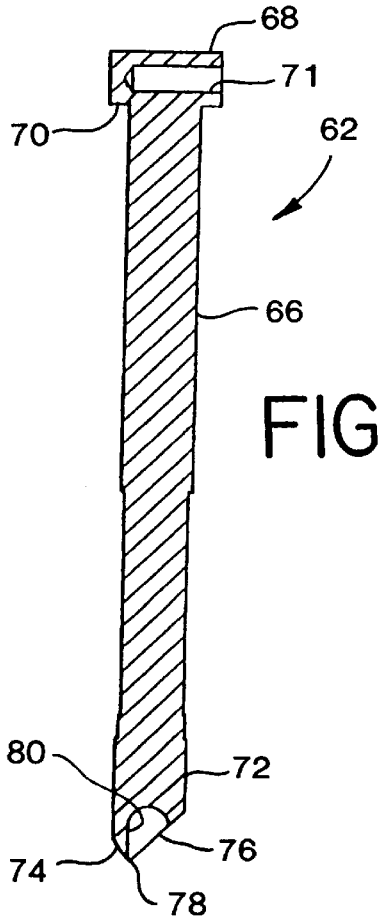
FIG.5

TIP FOR LIQUID DROP DISPENSING CONTAINER

FIELD OF THE INVENTION

This invention relates to drop dispensing containers and, in particular, to a drop forming tip for such liquid dispensing containers.

BACKGROUND OF THE INVENTION

Various drop dispensing containers have been used and are known in the art. Such containers include tips configured to form and release drops of liquid such as, for example, liquid medication into the eyes of a user, or the like. Despite the availability and use of these various containers, liquid medication often cannot be dispensed without dripping, thereby generating expensive waste. Thus, there remains a need for an improved tip for such containers which tip can reliably dispense substantially uniform drops without dripping. The present invention satisfies this need.

SUMMARY OF THE INVENTION

A liquid drop dispensing container is provided with a dispensing tip that includes a hollow stem which defines a liquid passageway. An interior partition wall within the stem divides the liquid passageway into an upstream chamber and a downstream chamber. The upstream chamber communicates with the interior of the container, and the downstream chamber terminates in a liquid drop outlet. A liquid passage is provided in the interior partition wall and provides flow communication between the upstream chamber and the downstream chamber. A unitary head portion extends into the downstream chamber from the partition wall and defines a rounded liquid impingement surface. Liquid passing from the upstream chamber into the downstream chamber contacts the rounded impingement surface and passes dropwise through the liquid drop outlet.

In a preferred embodiment, the liquid passage is positioned off-center and spaced from the liquid impingement surface. The interior partition wall includes opposed and outwardly diverging first and second faces which partially define the downstream chamber. The liquid passage terminates in an aperture located in the first face, and the unitary head portion extends outwardly into the downstream chamber from the second face.

The present invention also contemplates an apparatus for molding the liquid drop dispensing tip for a container. The apparatus includes a first mold insert for forming one side of the interior partition wall as well as the downstream chamber within the tip, and a second mold insert for forming the other side of the partition wall as well as the upstream chamber within the tip. The second mold insert includes an elongated pin for forming the liquid passage in the partition wall.

The distal end portion of the first mold insert includes first and second inclined faces which intersect along an edge. A cavity in the first inclined face of the first mold insert is complementary to an forms the rounded impingement surface which extends from the partition wall into downstream chamber.

The second mold insert includes a pin which extends longitudinally therethrough. The distal tip of the pin projects beyond the second mold insert. When both mold inserts are positioned against one another during the tip molding process, the distal tip of the pin abuts one face of the first mold insert and forms the liquid passage between the upstream and downstream chambers as molding material is injected into the mold. The mold inserts are urged against one another during molding.

Other features and advantages of the present invention will become readily apparent from the following detailed description, the appended drawings, and the accompanying claims.

BRIEF DESCRIPTION OF THE DRAWINGS

In the drawings,

FIG. 3 is an enlarged broken vertical cross-sectional view of the drop dispensing tip of FIG. 2;

FIG. 4 is a perspective view of a mold insert constructed in accordance with the present invention for forming the drop dispensing tip;

FIG. 5 is a vertical cross-sectional view of the mold insert of FIG. 4;

DETAILED DESCRIPTION OF PREFERRED EMBODIMENTS

Figure 1:
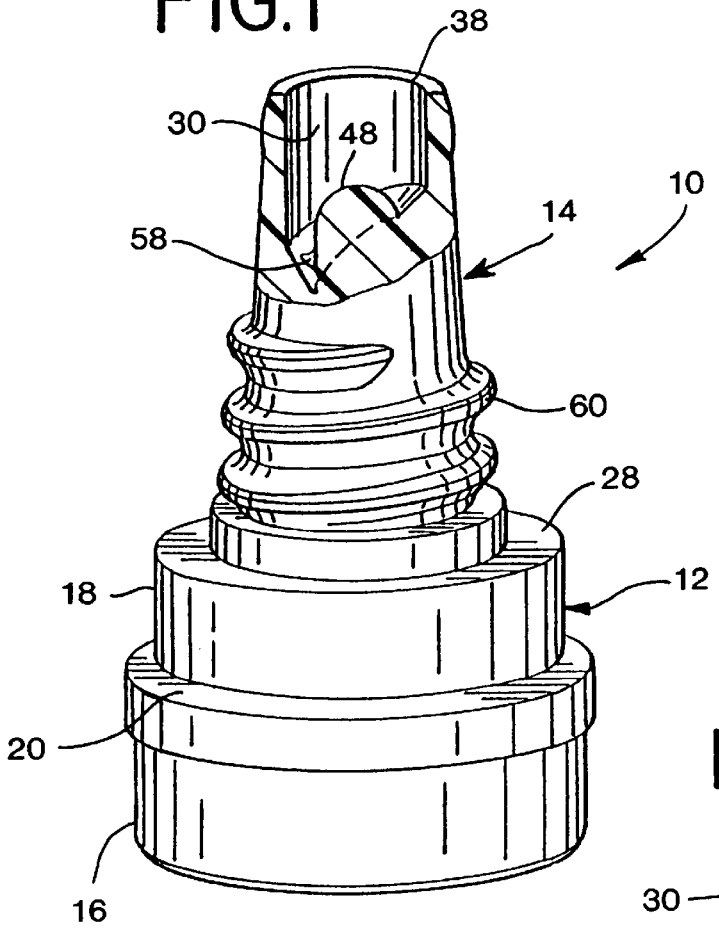
FIG. 1 is a perspective view of a drop dispensing tip, partially broken away to show interior detail.

The invention disclosed herein is, of course, susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

For ease of description, the drop dispensing container and tip thereof embodying the present invention and the apparatus for forming such tip also embodying the present invention are described hereinbelow in their usual vertical position as shown in all but FIG. 3 and terms such as upper, lower, vertical, etc., will be used herein with reference to this usual position.

Moreover, the Figures also include structural elements of the drop dispensing tip and the apparatus for forming the tip that are known in the art, and that will be recognized by those skilled in the art as such. Detailed descriptions of such elements are not necessary to an understanding of the present invention. Accordingly, such elements are herein represented only to the degree necessary to assist in understanding the features of the present invention.

Figure 2:
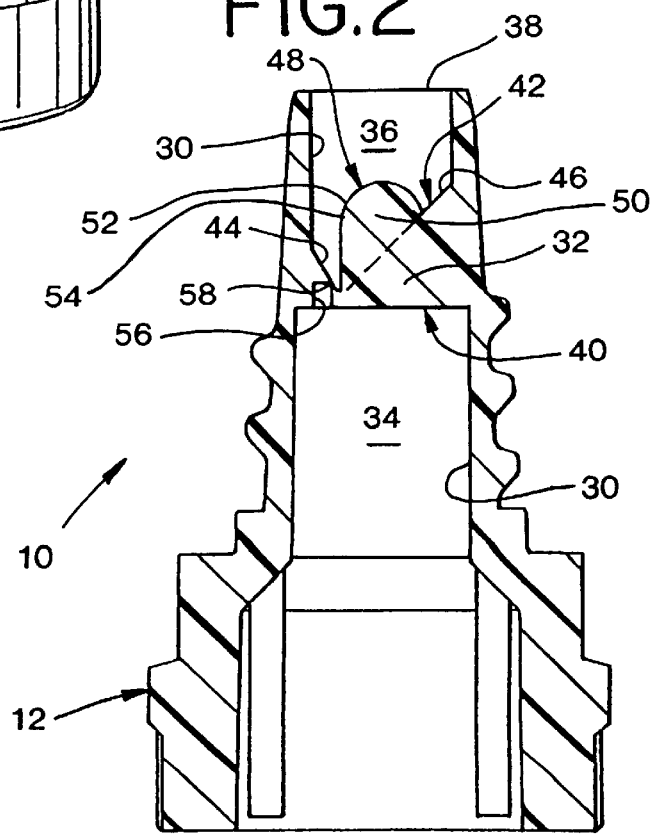
FIG. 2 is a vertical cross-sectional view of the container tip of FIG. 1.

Referring now to the drawings, and more particularly to FIGS. 1–3, there is shown a liquid drop dispensing tip 10 suitable as an insert for a container the liquid contents of which is to be dispensed dropwise.

The tip 10 is preferably injection molded using a conventional molding material such as high density polyethylene, low density polyethylene, polypropylene and the like. The tip 10 can be utilized with liquid drop dispensing containers having a wide variety of shapes and capacities depending upon the desired application. U.S. Pat. No. Des. 369,211 to Weiler illustrates one such liquid dispensing container.

The tip 10 is a separately molded subassembly adapted to be inserted, immobilized and subsequently sealed within the throat portion of a container such as, for example, the inserts described in U.S. Pat. No. 5,351,462 to Anderson and U.S. Pat. No. 4,707,966 to Weiler et al.

As shown in FIG. 1, tip 10 includes a base 12 and a hollow stem 14 which defines a liquid passageway 30. The base 12 includes a lower generally cylindrical base member 16 and a unitary intermediate generally cylindrical base member 18 having a diameter less than the diameter of the base member 16. A radially and circumferentially extending shoulder 20 is situated between the two base members 16 and 18. Base 12 is encapsulated in the neck portion of a liquid container.

The hollow stem 14 extends upwardly from shoulder 28 of the base member 18. External threads 60 can be provided on stem 14 to threadedly receive a closure cap (not shown).

An interior partition wall or septum 32 (FIG. 2) divides passageway 30 of stem 14 into an upstream chamber 34 and downstream chamber 36. The upstream chamber 34 is in communication with the container interior and the downstream chamber 36 terminates in a liquid drop outlet 38. Liquid passage 56 provides confined flow communication between chambers 36 and 38 and terminates in aperture 58 which preferably has a crescent-like configuration.

Surface 40 of partition well 32 defines the upper portion of chamber 34. Surface 42 of partition wall 32 defines opposed inclined first and second faces 44 and 46 respectively which diverge upwardly and outwardly toward drop outlet 38.

The face 44 is inclined at an angle in the range of approximately thirty (30) and seventy five (75) degrees relative to surface 40 of the partition wall 32. Preferably, the face 44 is inclined at an angle of approximately sixty (60) degrees.

Head portion 48 is unitary with wall 32 and extends outwardly from the inclined face 46. The head portion 48 includes a generally cylindrical body 50 and a unitary, dome-shaped top 52. Head portion 48 defines a rounded liquid impingement surface 54 configured to form and release successive drops of liquid through the distal tip liquid outlet 38 as described in detail below.

Surface 40 of the partition wall 32 is generally flat and traverses passageway 30. A generally cylindrical liquid passage or aperture 56 is defined in partition wall 32 and located off-center of the longitudinal axis of passageway 30. Liquid passage 56 terminates in the inclined face 44 of the outlet surface 42 and defines an aperture or opening 58 therein (FIGS. 2 and 3) through which liquid flows from the container and against rounded liquid impingement surface 54.

In the embodiment shown, the liquid passage 56 and the aperture 58 are located adjacent to but spaced from the head portion 48 and the liquid impingement surface 54 thereof.

As a liquid aliquot flows from the upstream chamber 34 (FIGS. 2 and 3) into the downstream chamber 36 through the confined flow passage 56 in the partition wall 32, the liquid comes in contact with the liquid impingement surface 54 thereof and flows along the dome-shaped top 52. As a result, drops of liquid are formed and subsequently released through the liquid drop outlet 38. The size of the drops formed and subsequently released from the top of the head portion 48 can be adjusted by varying the inside diameter of the liquid passageway 30.

Figure 6:
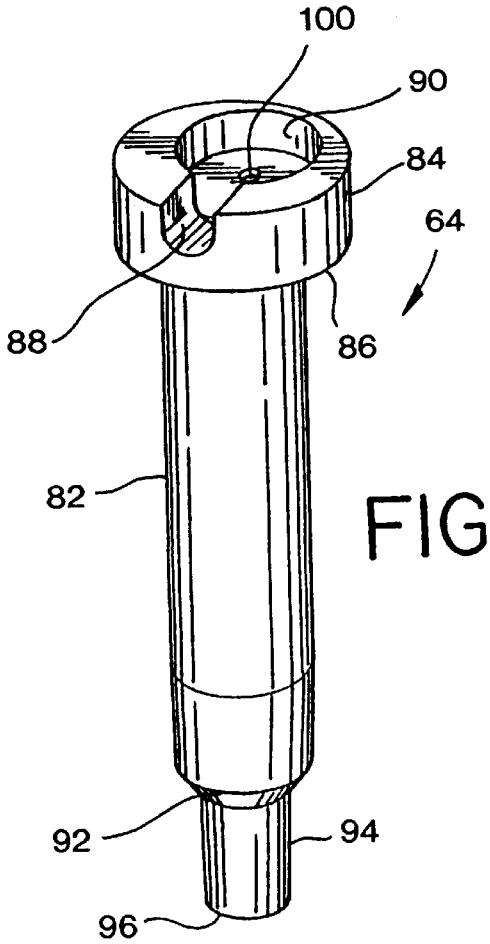
FIG. 6 is a perspective view of another mold insert constructed in accordance with the present invention which co-acts with the mold insert of FIG. 4 to form the drop dispensing tip.
Figure 7:
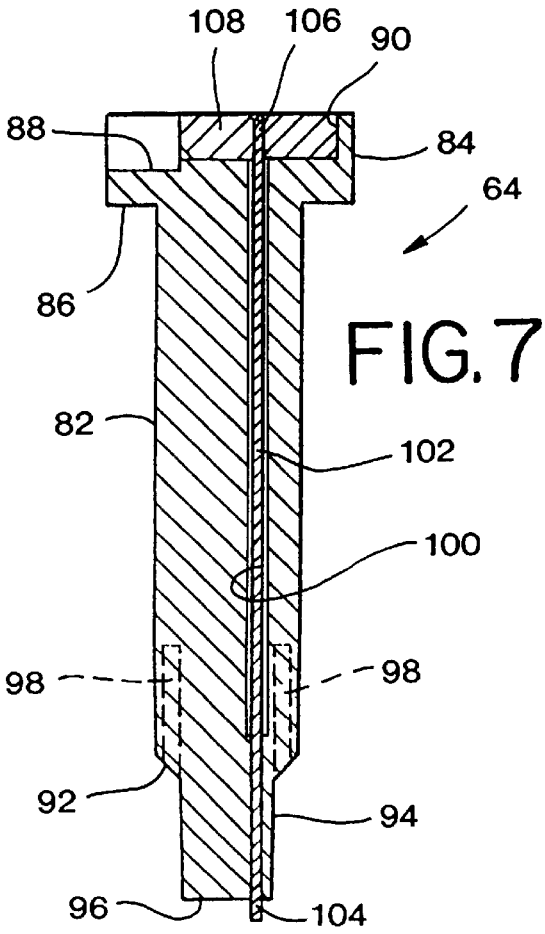
FIG. 7 is a vertical cross-sectional view of the mold insert of FIG. 6.

A dispensing tip of the present invention can be injection molded using mold inserts 62 (FIGS. 4 and 5) and 64 (FIGS. 6 and 7).

Referring to FIGS. 4 and 5, the mold insert 62 is generally made of steel or the like material and is an elongated solid body portion 66 with a proximal generally cylindrical head portion 68 having a diameter greater than the body portion 66. A radially outwardly extending shoulder 70 is defined between the body portion 66 and the head portion 68. The head portion 68 includes a bore 71 which is adapted to receive an insert mounting screw (not shown). Distal end 72 of mold insert 62 is configured for forming in the interior partition wall 32 faces 42 and 44 as well as head portion 48. The distal end 72 includes first and second opposed and outwardly converging inclined faces 74 and 76 respectively which intersect along an elongate distal edge 78. The face 74 also defines a generally oval cavity 80 therein complementary in shape to head portion 48.

Referring to FIGS. 6 and 7, the mold insert 64 coacts with mold insert 62 and, like the insert 62, is also made of steel or similar material. Mold insert 64 has an elongate generally solid body 82 and a proximal generally cylindrical head portion 84 having a diameter greater than the body portion 82 so as to define a shoulder 86 therebetween. The head portion 84 includes a first cavity or key hole 88 which extends inwardly from the peripheral circumferential edge of the head portion 84 and terminates in a cylindrical cavity 90 also located in the head portion 84.

An inwardly tapered shoulder 92 is provided on mold insert 64 which terminates in a distal end portion 94 having a diameter less than the diameter of the body portion 82. The distal end portion 94 terminates in a radial flat face 96.

Figure 8:
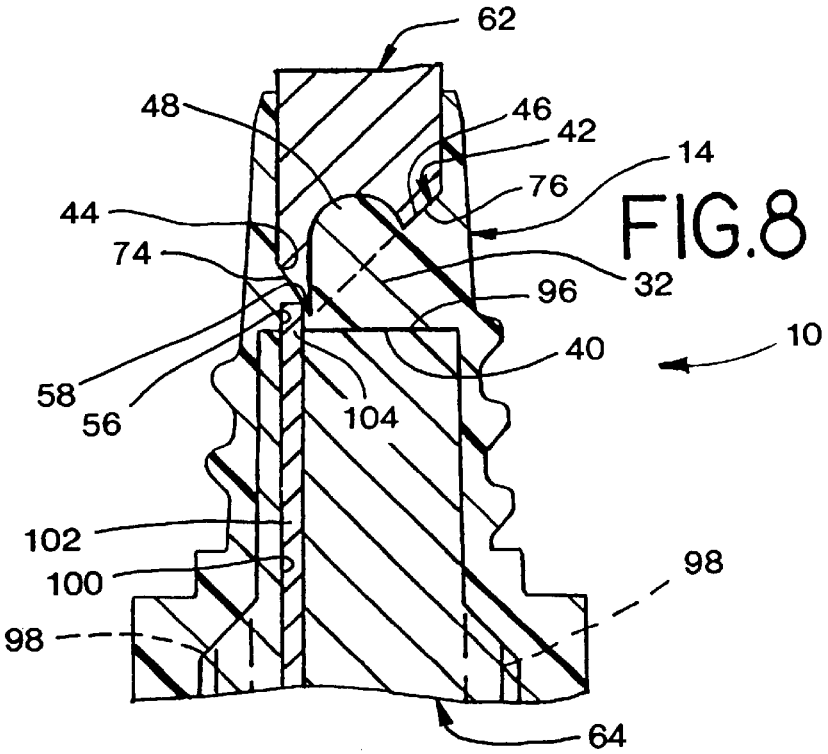
FIG. 8 is an enlarged partially broken away vertical cross-sectional view depicting the mold insert of FIG. 4 and the mold insert of FIG. 6 positioned for forming the inlet and outlet chambers of the tip.

Elongate cavities 98 are provided in mold insert 64 and extend longitudinally inwardly from the shoulder 92 into the interior of the body 82 in spaced-apart and parallel relationship to the outer surface. Although FIGS. 7 and 8 depict only two such cavities 98, the mold insert embodiment illustrated in FIGS. 6 and 7 includes three such cavities 98 an in equidistant spaced-apart relationship. These cavities form ribs in the molded tip which minimize nesting of the tips when they are fed to an insertion station during a blow/fill/seal container manufacture.

Additionally, a bore 100 extends longitudinally through the entire length of mold insert 64.

An elongate pin 102 is received in the bore 100 and includes a distal tip 104 which projects outwardly from the distal radial face 96. The proximal end 106 of the pin 102 is secured to a washer 108 received within the cavity 90.

As shown in FIG. 8, the mold inserts 62 and 64 are configured for forming the interior partition wall 32 and the respective downstream and upstream chambers 36 and 34 of tip 10.

During molding, mold inserts 62 and 64 are positioned in an opposed relationship as shown in FIG. 8 so that the tip 104 of the pin 102 abuts face 74 of mold insert 62. In this manner liquid passage 56 as well as aperture 58 of a pre-set size and dimension are formed as thermoplastic material is introduced in the mold to form the tip.

It will be readily apparent from the foregoing detailed description of the invention and from the illustrations thereof that numerous variations and modifications may be effected without departing from the true spirit and scope of the novel concepts or principles of this invention.

We claim:

1. A liquid drop dispensing tip for a container and having a hollow stem which defines a liquid passageway and includes an interior partition wall that separates the liquid passageway into an upstream chamber which communicates with the container and a downstream chamber which terminates in a liquid outlet; said interior partition wall further defining a confined liquid passage off-center of the longitudinal axis of the liquid passageway and situated between the upstream chamber and the downstream chamber, and a rounded liquid impingement surface on the interior partition wall in the downstream chamber situated so that the liquid exiting the liquid passage contacts the liquid impingement surface before passing dropwise through the liquid outlet.

2. The liquid drop dispensing tip of claim 1 wherein said confined liquid passage is positioned in a spaced-apart relationship relative to said liquid impingement surface.

3. The liquid drop dispensing tip of claim 1 wherein the liquid impingement surface is dome-shaped.

4. The liquid drop dispensing tip of claim 1 wherein the confined liquid passage terminates in a crescent-shaped aperture in the interior partition wall.

5. The liquid drop dispensing tip of claim 1 wherein the hollow stem is provided with external threads.

6. The liquid drop dispensing tip of claim 1 wherein the liquid impingement surface is situated along the longitudinal axis of the hollow stem and the liquid passage terminates in an aperture in the interior partition wall spaced from the longitudinal axis of the hollow stem and from the liquid impingement surface.

7. The liquid drop dispensing tip of claim 1 wherein the interior partition wall defines a pair of diverging faces in the downstream chamber and wherein the liquid passage terminates in an aperture in one of the diverging faces and the rounded liquid impingement surface is defined by the other of the diverging faces.

* * * * *